US007397429B2

(12) United States Patent
Crain et al.

(10) Patent No.: US 7,397,429 B2
(45) Date of Patent: Jul. 8, 2008

(54) AIRCRAFT WINDOW PLUG ANTENNA ASSEMBLY

(75) Inventors: Bruce Richard Crain, Melbourne Beach, FL (US); Richard Wayne Botsford, Melbourne, FL (US); David W. Lee, Palm City, FL (US); Edward Lee Kirchner, Indialantic, FL (US)

(73) Assignee: Northrop Grumman Corporation, Los Angeles, CA (US)

( * ) Notice: Subject to any disclaimer, the term of this patent is extended or adjusted under 35 U.S.C. 154(b) by 220 days.

(21) Appl. No.: 10/796,440

(22) Filed: Mar. 9, 2004

(65) Prior Publication Data

US 2005/0200526 A1 Sep. 15, 2005

(51) Int. Cl.
*H01Q 1/38* (2006.01)

(52) U.S. Cl. ..... 343/700 MS

(58) Field of Classification Search ..... 343/700 MS, 343/705, 708

See application file for complete search history.

(56) References Cited

U.S. PATENT DOCUMENTS

| | | | | |
|---|---|---|---|---|
| 3,613,098 | A | 10/1971 | Blasko | |
| 3,945,014 | A | 3/1976 | Kunert et al. | |
| 3,977,004 | A | 8/1976 | Bickel | |
| 4,132,995 | A | 1/1979 | Monser | |
| 4,291,311 | A | 9/1981 | Kaloi | |
| 5,184,141 | A | 2/1993 | Connolly et al. | |
| 5,355,144 | A | 10/1994 | Walton et al. | |
| 5,724,049 | A | 3/1998 | Park et al. | |
| 5,959,586 | A | 9/1999 | Benham et al. | |
| 6,094,176 | A * | 7/2000 | Van Hoozen et al. | 343/792.5 |
| 6,160,522 | A | 12/2000 | Sanford | |
| 6,198,445 | B1 * | 3/2001 | Alt et al. | 343/705 |
| 6,366,254 | B1 | 4/2002 | Sievenpiper et al. | |
| 6,407,711 | B1 * | 6/2002 | Bonebright et al. | 343/705 |
| 6,480,170 | B1 | 11/2002 | Langley et al. | |
| 6,496,151 | B1 | 12/2002 | Ferreri et al. | |
| 6,714,163 | B2 * | 3/2004 | Navarro et al. | 343/705 |
| 6,759,980 | B2 * | 7/2004 | Chen et al. | 342/372 |
| 2002/0109634 | A1 * | 8/2002 | Aisenbrey | 343/700 MS |
| 2004/0262453 | A1 * | 12/2004 | Sanz et al. | 244/129.3 |

FOREIGN PATENT DOCUMENTS

| | | |
|---|---|---|
| JP | 3036804 | 2/1991 |

* cited by examiner

*Primary Examiner*—Huedung Mancuso
(74) *Attorney, Agent, or Firm*—Robert P. Lenart, Esq.; Pietragallo Gordon Alfano Bosick & Raspanti, LLP

(57) ABSTRACT

A conformal load-bearing antenna assembly comprises a pan shaped to fit within an aircraft window opening, an antenna element disposed within the pan, and a connection for coupling a signal to the antenna element.

12 Claims, 5 Drawing Sheets

AIRCRAFT WINDOW PLUG ANTENNA ASSEMBLY

FIELD OF THE INVENTION

This invention relates to antenna assemblies, and more particularly to antenna assemblies for use on aircraft.

BACKGROUND OF THE INVENTION

Modern aircraft have a need to provide radio communication over a variety of frequency ranges and communication modes. For example, radio communication may be in the UHF band or the L band. In order to communicate effectively, the aircraft must include multiple antennas placed in various locations on the aircraft. Typically, the aircraft may include antennas mounted behind the radio transparent skin of the aircraft, and/or exterior blade antennas mounted on the skin of the aircraft. Blade antennas are small fins protruding from the skin of the aircraft that are used as the radiating element. The blade antennas are electrically matched through impedance matching networks to transmitting and receiving equipment.

Blade antennas are aerodynamically inefficient because they protrude from the skin of the aircraft. Typically, multiple blade antennas are used on the aircraft to accommodate multiple communications bands (i.e., UHF, VHF/FM, VHF/AM). Blade antennas are constructed to withstand the forces subjected to the antenna. However blade antennas are still susceptible to impact damage. In addition, blade antennas do not add any structural strength to the aircraft, and may interfere with the aerodynamic efficiency of the aircraft.

Antenna radiating elements may also be embedded within the skin of the aircraft. Such radiating elements provide an antenna structure for the aircraft that is structurally integrated within the skin thereof. However, these embedded antenna structures are typically difficult to manufacture and install. Additionally, embedded antenna structures may not exhibit ideal gain characteristics.

A significant problem facing some aircraft is a lack of space on the top and bottom surfaces of the fuselage to mount antennas. If it were possible to relocate existing blade antennas, additional surface area on the aircraft fuselage would be available for new antennas. In addition, cosite interference to existing blade antennas could be reduced.

The present invention addresses the above-mentioned deficiencies in prior aircraft antenna design by providing an antenna assembly that fits into existing openings in an aircraft at portions of the fuselage not previously used for mounting antennas.

SUMMARY OF THE INVENTION

A conformal load-bearing antenna assembly constructed in accordance with this invention comprises a pan shaped to fit within an aircraft window opening, an antenna element disposed within the pan, and a connection for coupling a signal to the antenna element.

DETAILED DESCRIPTION OF THE INVENTION

Figure 1:
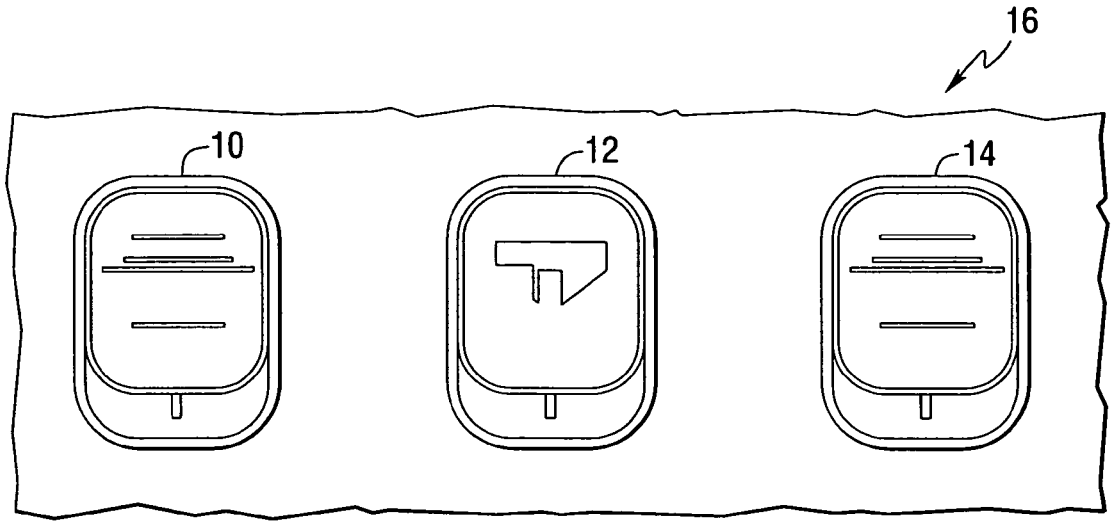
FIG. 1 is a pictorial representation of the antenna structures of this invention mounted in aircraft window openings.

Referring to the drawings, FIG. 1 is a pictorial representation of three antenna assemblies of this invention 10, 12 and 14 mounted in window openings of an aircraft fuselage 16. The antenna assemblies include window plugs and antenna elements supported by the window plugs. The modern aircraft is a sealed pressure vessel containing an atmosphere at near sea level pressure. The window plug must be designed to meet the ultimate pressure of the aircraft without any failure. The window plugs must also withstand cabin rapid decompression.

Figure 2:
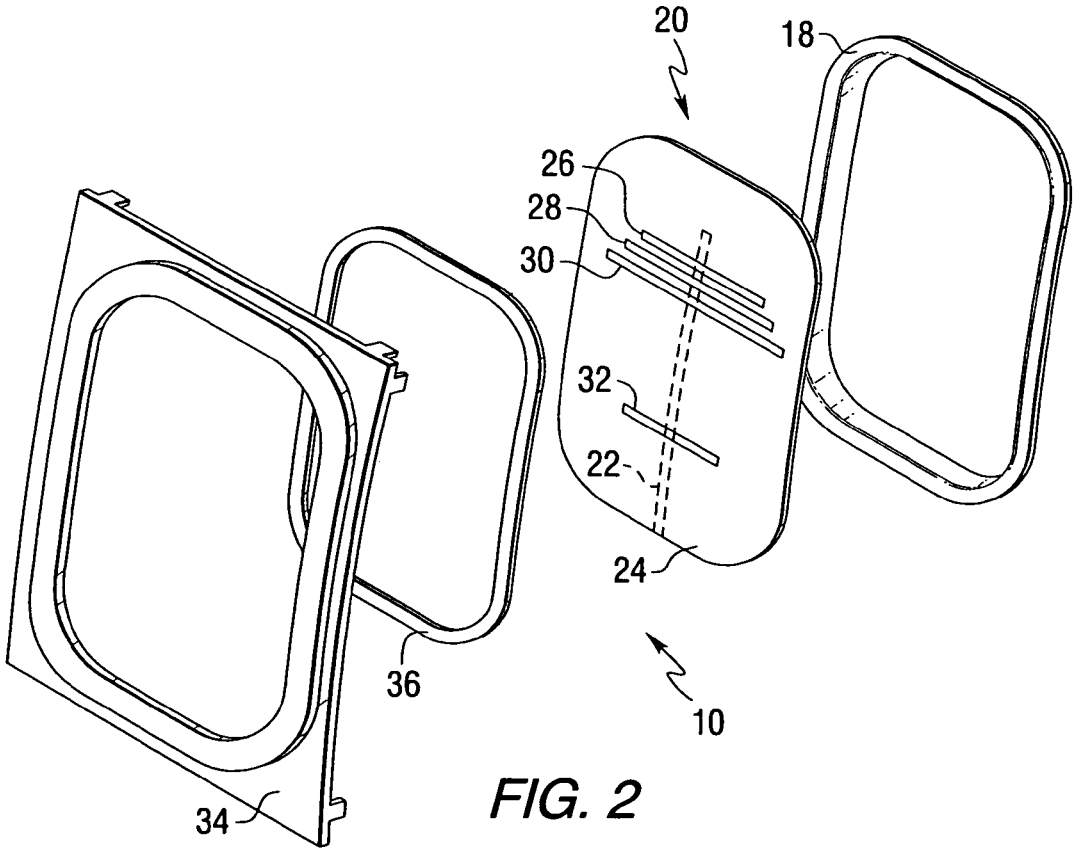
FIG. 2 is an exploded view of an antenna assembly constructed in accordance with one embodiment of the invention.

FIG. 2 is an exploded view of a UHF antenna assembly 10 constructed in accordance with one embodiment of the invention, and shows how the antenna fits into an aircraft window opening. The antenna assembly 10 includes a pan 18 that provides structural rigidity. An antenna 20 is positioned within the pan and includes a metal stripline 22 supported by a sheet of dielectric material 24 and a plurality of radiating elements 26, 28, 30 and 32 electrically coupled to the stripline. The pan forms a cavity that is positioned behind the antenna, thereby forming a cavity backed antenna. A conductive gasket 36 is positioned between the antenna and the window frame of the aircraft 34. The antenna is shaped to fit within a window opening in the fuselage of an aircraft 34.

Figure 3:
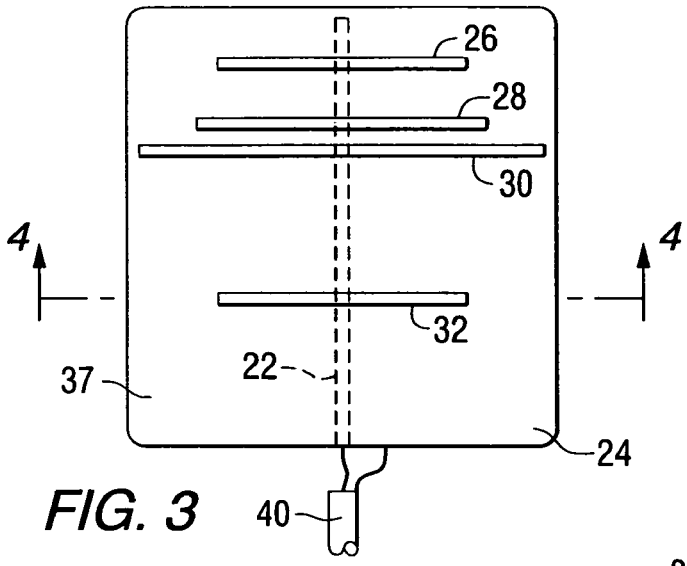
FIG. 3 is a plan view of the antenna element of the antenna assembly of FIG. 2.
Figure 4:
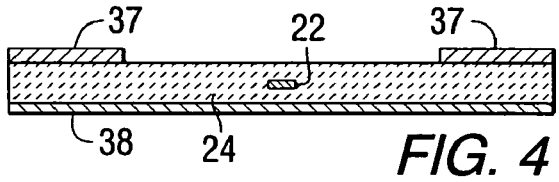
FIG. 4 is a cross-sectional view of the antenna element of FIG. 3 taken along line 4-4.

FIG. 3 is a schematic plan view of the antenna element of the antenna assembly of FIG. 2, and FIG. 4 is a cross-sectional view of the antenna element of FIG. 3 taken along line 4-4. Stripline 22 is shown to be embedded in the sheet of dielectric material 24. A metal layer or sheet 38 is positioned adjacent to the back of the sheet of dielectric material 24. A metal layer or sheet 37 is positioned adjacent to the front of the sheet of dielectric material 24. A feed line 40 is electrically connected to the stripline 22 and the metal layer 38. The metal layer 37 covers the entire upper surface of the antenna element, except where the slots are cut out. Metal layer 38, on the bottom of the antenna, forms a ground plane. Copper tape is used to electrically bond the upper metal layer 37 and the lower metal layer 38 around the periphery of the antenna element. Lower metal layer 38 is electrically bonded to the pan during assembly using a conductive adhesive.

Figure 5:
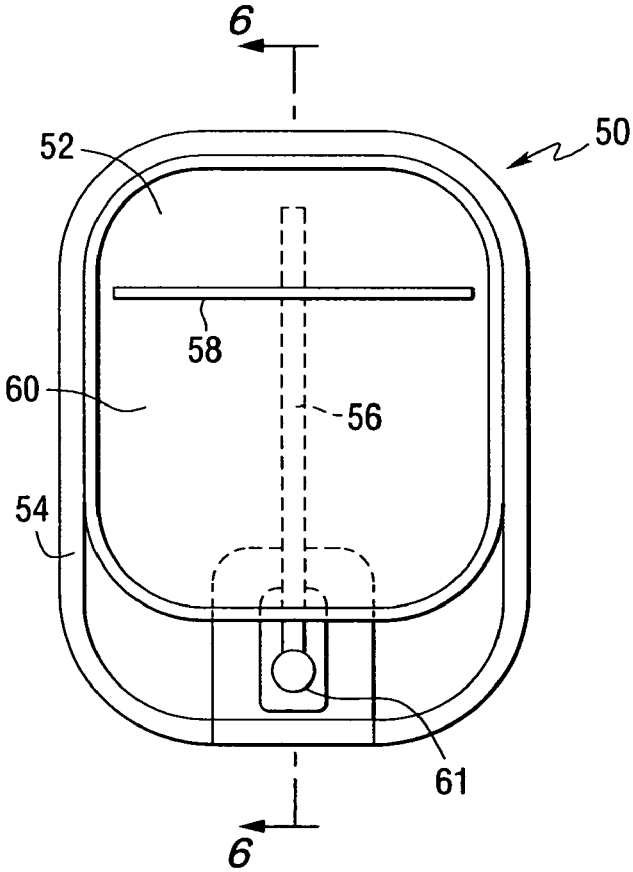
FIG. 5 is a plan view of another antenna assembly constructed in accordance with the invention.

FIG. 5 is a plan view of another antenna structure 50 constructed in accordance with this invention. The antenna structure 50 includes an antenna 52 mounted in a pan 54. The pan is shaped to fit within a window opening in an aircraft fuselage. The antenna includes a stripline 56 embedded in the dielectric substrate and a radiating aperture 58 that is coupled to the stripline. The aperture 58 is etched out of a sheet of metal 60 that covers the face of the antenna. A connector 61 is mounted in the pan and is used to supply a signal to the stripline.

Figure 6:
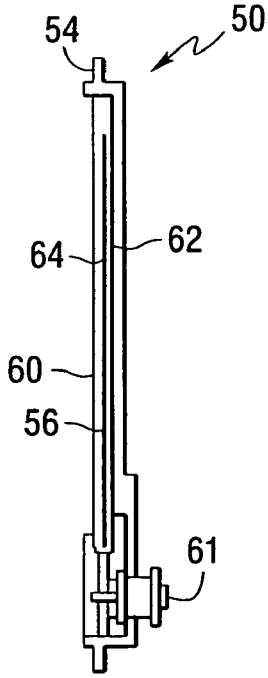
FIG. 6 is a cross-sectional view of the antenna element of the antenna assembly of FIG. 5.

FIG. 6 is a cross-sectional view of the antenna 50 shown in FIG. 5. In FIG. 6, a metal layer 64 covers the back side of the sheet of dielectric material, and is electrically bonded to the pan 54. A second metal layer 60 is positioned on the front side of the dielectric sheet. One or more slots can be formed in the second metal layer adjacent to the radiating element 56 for a slot antenna. The connector is used to make an additional electrical connection to this metal layer.

Figure 7:
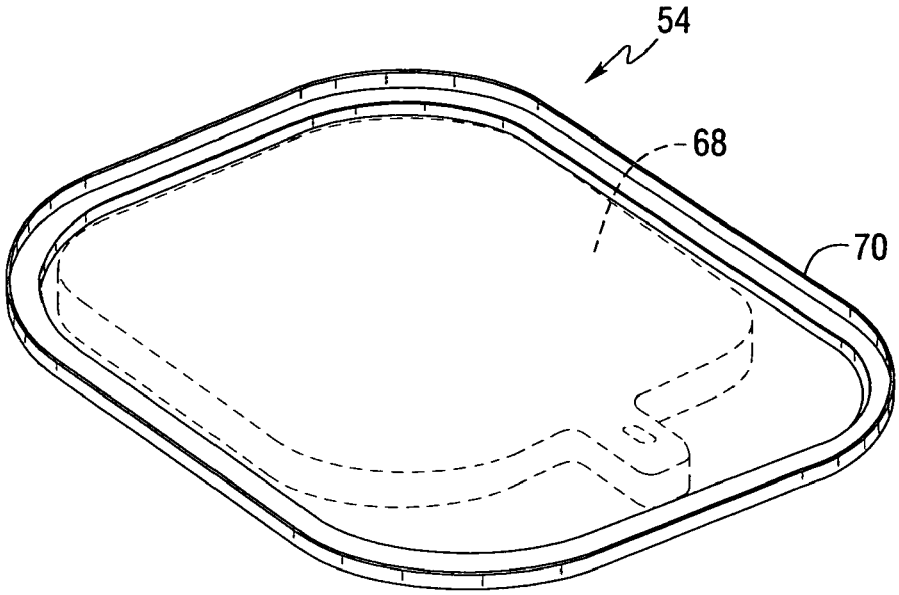
FIG. 7 is a perspective view of a pan that can be used in the antenna assemblies of this invention.

FIG. 7 is a perspective view of the back side of the pan 54 of the structure of FIG. 5. The pan 54 includes a recessed portion 68 that is milled out of the front of the pan, thereby creating a volume where an antenna element and RF cabling can be installed. A flange 70 is provided along the edge of the pan. When the pan is mounted in an aircraft window opening, a conductive gasket is positioned adjacent to the flange and in electrical contact with a portion of the aircraft fuselage.

Figure 8:
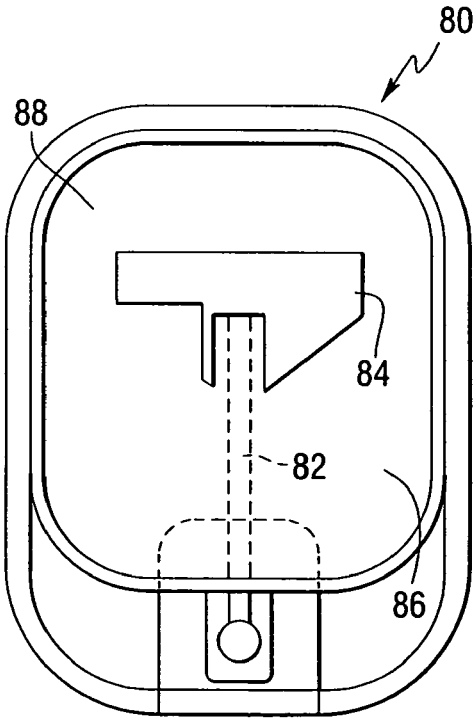
FIG. 8 is a plan view of an alternative antenna radiating element that can be used in the antenna assemblies of this invention.

FIG. 8 is a schematic plan view of an L-Band antenna 80 that can be used in the antenna assemblies of this invention. Antenna 80 includes a stripline 82 and a radiating aperture 84 electrically coupled to the stripline. A sheet of dielectric material 86 supports the stripline. A conductive backplane is provided in the form of a metal layer positioned adjacent to the back of the sheet of dielectric material. A second metal layer 88 is positioned on the front side of the dielectric sheet, and the radiating aperture 84 is etched into this layer. A feed line can be electrically connected to the stripline and the metal layer as shown in the previously described embodiments.

Figure 9:
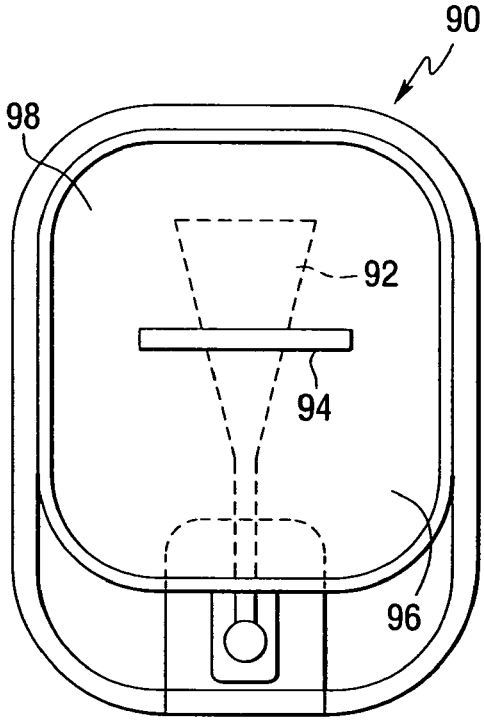
FIG. 9 is a plan view of an alternative antenna radiating element that can be used in the antenna assemblies of this invention.

FIG. 9 is a plan view of an alternative antenna 90 that can be used in the antenna assemblies of this invention. The antenna includes a tapered stripline 92 and a radiating aperture 94 electrically coupled to the tapered stripline. A sheet of dielectric material 96 supports the stripline. A second metal layer 98 is positioned on the front side of the dielectric sheet, and the radiating aperture 94 is etched into this layer. A feed line can be electrically connected to the stripline and the metal layer as shown in the previously described embodiments.

The antennas used in the assemblies of this invention can be fabricated using a plurality of layers of dielectric and bonding film material. Certain layers of the dielectric laminate material can be clad with a metal, such as copper, that can be etched to form the striplines and radiating elements of the antenna. Table 1 shows example antenna structures.

TABLE 1

Prototype Antenna Element Lay-up

| Layer Number (Looking into antenna face) | L-Band Antenna | UHF Antenna |
|---|---|---|
| 1 | Duroid ™ 6010, 100 mils thick, copper clad on top surface, slots etched onto cladding | Duroid ™ 5880, 125 mils thick, copper clad on top surface, slot etched onto cladding |
| 2 | 3001 Bonding Film | 3001 Bonding Film |
| 3 | Duroid ™ 6010, 100 mils thick, copper clad on top surface, stripline etched onto cladding | Duroid ™ 5880, 125 mils thick, unclad |
| 4 | 3001 Bonding Film | 3001 Bonding Film |
| 5 | Duroid ™ 6010, 100 mils thick, unclad | Duroid ™ 5880, 125 mils thick, copper clad on top surface, stripline etched onto cladding |

TABLE 1-continued

Prototype Antenna Element Lay-up

| Layer Number (Looking into antenna face) | L-Band Antenna | UHF Antenna |
|---|---|---|
| 6 | 3001 Bonding Film | 3001 Bonding Film |
| 7 | Duroid ™ 6010, 100 mils thick, unclad | Duroid ™ 5880, 125 mils thick, copper clad on bottom surface |
| 8 | 3001 Bonding Film | 3001 Bonding Film |
| 9 | Duroid ™ 6010, 100 mils thick, unclad | Duroid ™ 6010, 100 mils thick, unclad |
| 10 | 3001 Bonding Film | 3001 Bonding Film |
| 11 | Duroid ™ 6010, 100 mils thick, copper clad on bottom surface | Duroid ™ 6010, 100 mils thick, copper clad on bottom surface |

This invention provides a Conformal Load Bearing Antenna Structure (CLAS) designed to replace an existing aircraft window plug and maintain the cabin pressure of the aircraft. CLAS technology can relieve antenna overcrowding by allowing existing antennas to be installed on presently unused fuselage locations.

This invention makes it possible to replace previously used UHF and L-Band blade antennas with conformal antennas that can fit into the fuselage side windows in the same manner as existing window plugs. For purposes of this description, the L-Band antennas cover the frequency range of 969 MHz-1215 MHz, and UHF antennas cover the frequency range of 225 MHz-400 MHz.

The antennas of this invention can be installed as direct replacements for the window plugs previously used to replace aircraft windows. These window plug antenna assemblies are designed so that they do not unacceptably infringe on the interior structure of the aircraft. The described embodiments use a stripline feed that excites slot radiating elements. The CLAS antennas are intended to be installed in pairs, located on the left and right sides of the fuselage at approximately the same fuselage station, and connected together to a radio using a coupler.

The L-Band antenna element can be assembled using Rogers Duroid™ material. The stripline and slot can be etched into the copper cladding of the Duroid™ sheet using standard printed circuit board etching techniques.

The antenna assemblies can be constructed in three steps: antenna element fabrication, antenna pan fabrication, and final assembly. The UHF and L-Band antenna elements are subassemblies comprising the appropriate stripline feed and radiating slots. The antenna pan can provide a common housing for both types of antennas. Final assembly includes the steps of bonding the antenna element into the antenna pan and connecting a short RF jumper cable between the antenna element and the antenna pan.

The stripline and slot layers can be etched using standard photo-resist printed circuit board etching techniques. Custom end-launch connectors can be fabricated from standard bulkhead mount SMA connectors and brass plates. After trimming, the edges can be RF sealed using copper tape that is soldered to the front and back ground planes of the antenna elements. The copper tape can have a width of, for example, one inch (2.54 cm).

The antenna pan functions as a housing for the antenna element, a mount for the RF connector to the transmitter/receiver coaxial cable, and the pressure seal over the fuselage window opening. The window pan was designed as a pressure plug with the external side containing the antenna element and a bulkhead type electrical connector mounted through the pan. The antenna element itself plays no role in the mechanical stability of the antenna or in providing the pressure seal. The same antenna pan design can be used for both UHF and L-Band window plug antennas.

Figure 10:
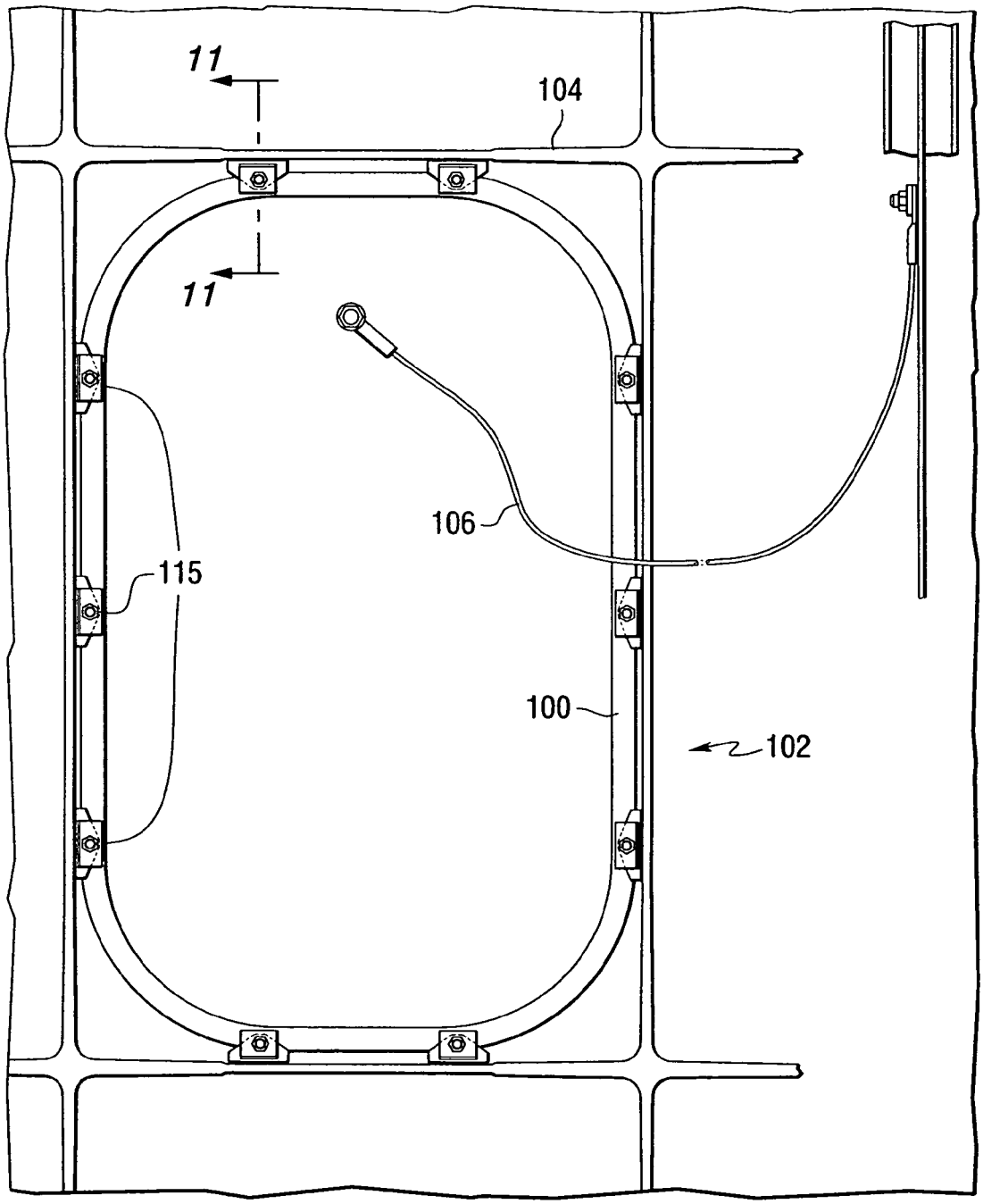
FIG. 10 is a plan view of a portion of an antenna assembly mounted in a window opening in an aircraft fuselage.
Figure 11:
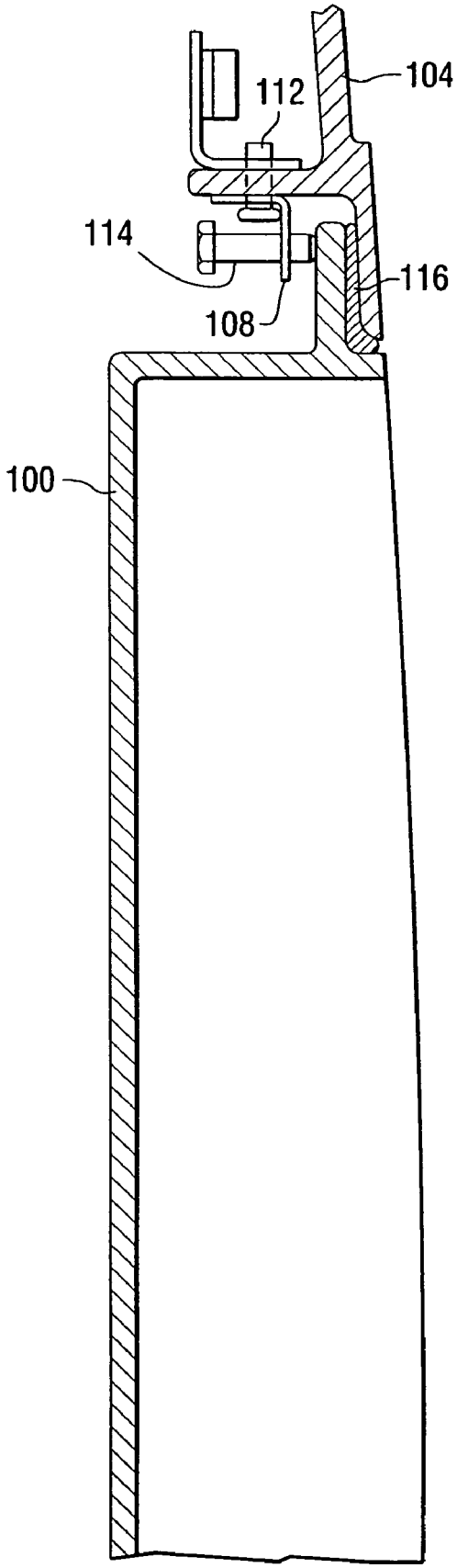
FIG. 11 is a detail view showing mounting hardware used to connect the antenna assembly pan to the aircraft window opening.

FIG. 10 is a plan view of a portion of an antenna assembly 100 mounted in a window opening 102 in an aircraft fuselage 104. A bonding strap 106 is connected between the antenna and the aircraft structure to carry lightning currents. Ten mounting clips 105 hold the window plug antenna to the fuselage. FIG. 11 is a detail view showing one of the mounting clips used to connect the pan to the aircraft window opening. The mounting clip is comprised of a bracket 108 that is attached to the window frame 104 by fastener 112 and pushes against the antenna assembly using fastener 114. An EMI gasket 116 is located between the outer edge of the antenna assembly 100 and fuselage 104, and provides electrical bonding as well as a pressure seal.

The antenna pan must maintain a pressure seal around the periphery of the antenna where it mates with the aircraft fuselage. This pressure seal must also be electrically conductive. It is required that the antenna element ground plane be electrically bonded to the aircraft structure around its periphery to achieve the desired antenna performance and to reduce electromagnetic radiation into the aircraft cabin. A tight seal should be maintained between the antenna assemblies and the fuselage window plug frame. A conductive silicone elastomer gasket can be placed around the periphery of the antennas. With the exception of replacing the gasket, the window plug antenna mates to the fuselage using the same hardware as the original window plug. The antenna pans can be machined out of solid blocks of aluminum, using a numerically controlled milling machine, and finish coated.

A bulkhead N-type RF connector with a semi-rigid jumper terminated in a SMA-type RF connector can be installed in the antenna pan, with the bulkhead N-type connector protruding out the back of the antenna pan. The SMA connector on the other end of the jumper mates to the connector on the antenna element. The antenna element is then bonded to the antenna pans using conductive adhesive. The gap between the antenna element and the inside of the antenna pan can be filet sealed around the periphery using non-conductive adhesive. A cover plate could be accommodated by deepening the jumper cable cavity or by having the jumper cable exit the bulkhead connector at a right angle.

Measured radio frequency isolation indicates that adjacent L-Band antennas constructed in accordance with this invention have exhibited approximately 10 dB additional isolation than similarly spaced L-Band blade antennas.

The antenna assemblies of this invention include a pan that is a structural replacement for existing window plugs. A portion of the pan is milled out so that any arbitrary antenna element can be bonded and mated to a connector on the back side of the pan. While UHF and L-Band antennas have been described, this same pan could house antenna elements designed for virtually any frequency, subject only to the limitations of the dimensions of the available volume in the pan.

While the invention has been described in terms of what are at present its preferred embodiments, it will be apparent to those skilled in the art that various changes can be made to the preferred embodiments without departing from the scope of the invention, which is defined by the claims.

What is claimed is:

1. A conformal load-bearing antenna assembly comprising:

a pan providing structural rigidity and shaped to fit within an aircraft window opening;

an antenna element disposed within the pan;

a connection for coupling a signal to the antenna element; and a conductive gasket positioned adjacent to the perimeter of the antenna assembly, electrically bonding the antenna assembly to an aircraft fuselage and providing a pressure seal.

2. The antenna assembly of claim 1, wherein the antenna element comprises a stripline supported by a dielectric sheet, and at least one radiating element coupled to the stripline.

3. The antenna assembly of claim 1, wherein the pan forms a pressure seal with the aircraft window opening.

4. The antenna assembly of claim 1, further comprising a bonding strap for carrying lightning currents from the antenna assembly to a fuselage of the aircraft.

5. The antenna assembly of claim 1, wherein the antenna element comprises a tapered stripline.

6. The antenna assembly of claim 1, wherein the pan forms a cavity behind the antenna element.

7. The antenna assembly of claim 1, wherein the pan is a structural replacement for a window plug.

8. The antenna assembly of claim 1, further comprising:

a radio frequency connector mounted in the pan.

9. The antenna assembly of claim 1, wherein the pan forms a pressure seal over a window opening.

10. A conformal load-bearing antenna assembly comprising:

a pan providing structural rigidity and shaped to fit within an aircraft window opening;

an antenna element disposed within the pan, wherein the antenna element comprises a stripline supported by a dielectric sheet, and at least one radiating element coupled to the stripline; and a connection for coupling a signal to the antenna element;

wherein the antenna element further comprises a front ground plane and a back ground plane, with the front ground plane forming one or more slots adjacent to the radiating element.

11. The antenna assembly of claim 10, wherein the front ground plane and the back ground plane are electrically bonded to each other.

12. The antenna assembly of claim 10, wherein the back ground plane is electrically bonded to the pan.

* * * * *